United States Patent [19]

Schweikert

[11] Patent Number: 4,479,739

[45] Date of Patent: Oct. 30, 1984

[54] MACHINE FOR LAYING SHAPED BRICKS

[76] Inventor: Otfried W. Schweikert, Mühlbachstrasse 13, D-8575 Kirchthumbach, Fed. Rep. of Germany

[21] Appl. No.: 268,335

[22] Filed: May 29, 1981

[51] Int. Cl.[3] ..... E01C 19/52

[52] U.S. Cl. ..... 404/99; 52/749

[58] Field of Search ..... 404/99, 73, 72; 52/749

[56] References Cited

U.S. PATENT DOCUMENTS

| | | | |
|---|---|---|---|
| 1,221,689 | 4/1917 | Coyne | 404/99 |
| 1,571,386 | 2/1926 | Straight | 404/99 |
| 3,867,051 | 2/1975 | Bjorhaag | 404/99 |
| 4,264,232 | 4/1981 | Schnier | 404/99 X |
| 4,277,201 | 7/1981 | Abell | 404/99 X |

FOREIGN PATENT DOCUMENTS

| | | | |
|---|---|---|---|
| 1928942 | 12/1970 | Fed. Rep. of Germany . | |
| 2718066 | 11/1978 | Fed. Rep. of Germany | 404/99 |
| 612991 | 6/1978 | U.S.S.R. | 404/99 |

*Primary Examiner*—James A. Leppink
*Assistant Examiner*—Beverly E. Hjorth
*Attorney, Agent, or Firm*—Hill, Van Santen, Steadman & Simpson

[57] ABSTRACT

A road construction machine for paving road surfaces with road stones or the like is disclosed which moves over the paved surface which has already been laid, without the use of guide rails. The machine carries a supply of road stones supported on a lift table. Each uppermost road stone slab is removed from the supply stack and inserted into a semi-circularly shaped transfer chute positioned at the forward end of the paving machine. The road stones are conducted through the chute and deposited onto the subgrade surface so as to be pressed sequentially against a previously laid pavement stone. As the road construction machine moves forwardly along the paved surface in the direction of the paving operation, hydraulic ram means serve to firmly press and flatten the laid stones into paving condition on the subgrade surface, utilizing the weight of the slab stack carried in the machine.

9 Claims, 5 Drawing Figures

MACHINE FOR LAYING SHAPED BRICKS

BACKGROUND OF THE INVENTION

1. Field of the Invention

The present invention relates to a road construction machine for laying road stones, and, in particular, slab or palletsize groups of paving bricks.

2. The Prior Art

German OS No. 1928942 discloses a road construction machine with which paving stones, bricks, or the like can be successively laid on a soft subgrade sand bed or road surface. This machine serves to transfer stones assembled in a supply stack carried by the machine onto the subgrade surface. The machine travels along the road surface guided over horizontal rails separately laid off to opposed transverse sides of the road bed, since support of the machine on the soft subgrade itself is not possible and would lead to destruction of the road surface.

The present invention relates to a road construction machine with which individual road stones or slab groups of road bricks can be laid directly on a soft subgrade, such as a sand bed in particular, without requiring separately laid support guide rail means along the opposed sides of the subgrade surface.

SUMMARY OF THE INVENTION

A movable road construction machine is provided with a lift table for supporting a supply of slab-size groups of road stones arranged in a stack. A transfer chute or track means is provided at the forward end of the machine for conducting individual slabs from the top end of the stack to a laid position on a road bed surface over which the machine is passed. The transfer track is shaped in the manner of a semicircle, such that each uppermost slab removed from the stack has its upper surface turned toward the road bed during laying operation. The road construction machine moves forwardly along the road surface in the direction of the paving operation, so that each subsequently-laid slab stone is pressed against previously-laid slab stones at the front of the machine and the road stones are pressed into paving condition as the machine passes over the just laid stones due to the weight of the supply slab stack carried in the machine. Thus, in a single operation, the road construction machine, moving only along the paved surface of the road bed, produces a firmly constructed paved highway or road surface.

The lift table elevates the supply stack slab layer by slab layer to an upper limit across from an inlet opening in the transfer chute. Each slab layer is passed into the chute by means of a laterally movable insertion device, preferably hydraulically operated, which pushes the slab into the chute, whereupon the slab slides down the chute under its own weight and out a delivery end, opening contiguous with the road bed, to be laid onto the subgrade. In cases where slab stones are not particularly even or flat, the transfer chute may be provided with guide roller means arranged therealong to promote the transport of the individual slabs to the road bed.

A planar support plate is mounted for lateral movement in the upper area of the road construction machine for insertion beneath each particular slab layer presented for insertion into the transfer chute. After the lift table raises a slab layer to the insertion position across from the inlet opening of the transfer chute, clamping means are applied which laterally support the slab and the remaining slab supply stack is lowered to form a gap between the slab to be inserted and the next adjacent slab sufficient to permit insertion of the support plate beneath the slab to be inserted. The clamping means are then released and, with the slab supported on the support plate, the insertion device is activated for pushing the slab into the transfer chute. The support plate may also be used to hold the slab layer up while the lift table is lowered in order to receive a new stack of slabs.

DESCRIPTION OF THE PREFERRED EMBODIMENT

Figure 1:
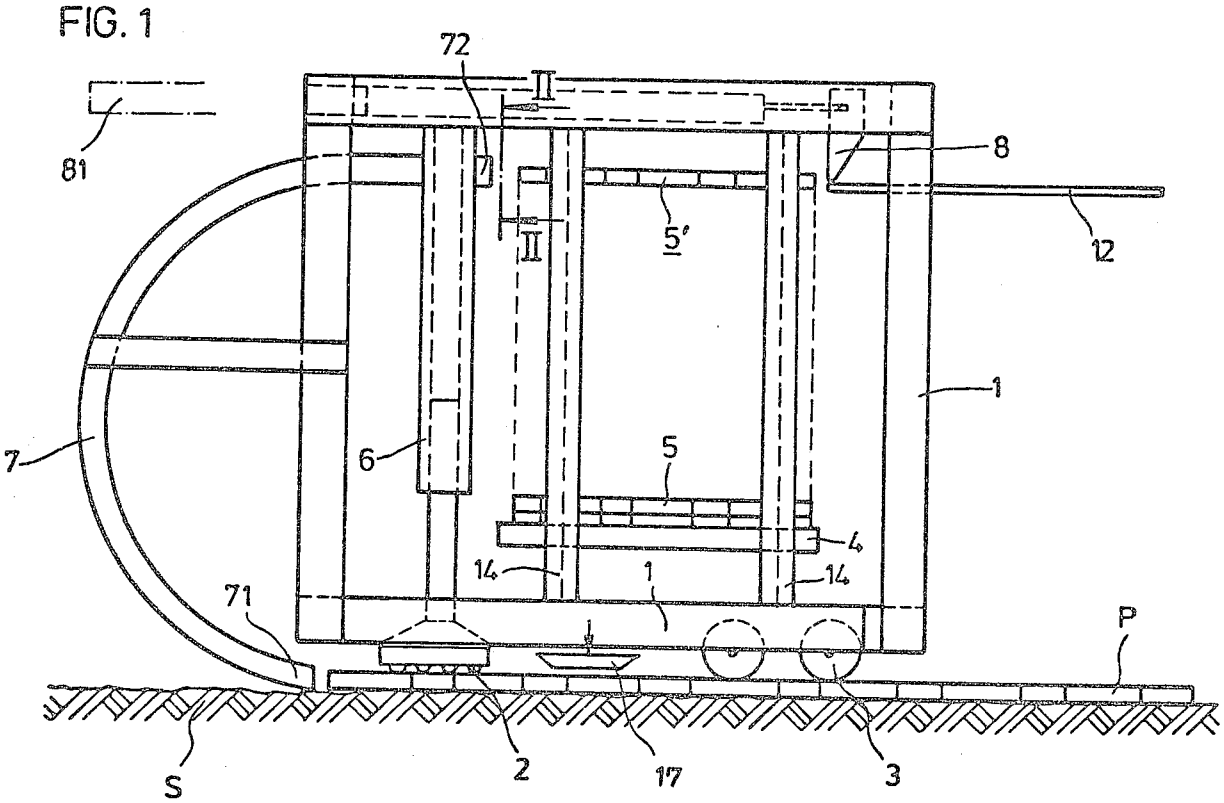
FIG. 1 is a schematic, side elevational view of a road construction machine formed in accordance with the present invention.

FIG. 1 illustrates a road construction machine 1 for paving a soft subgrade surface S, such as a sand bed, with road stones or bricks. The machine is supported for lateral movement over the road pavement P as it is laid on front transport wheel means 2 and rear transport rollers 3.

Positioned within the framework of the machine 1 is a lift table means having a vertically movable platform 4 controlled by suitable drive means (not shown). The drive means may take any suitable form, such as hydraulic piston actuation or electrically driven chain devices or the like. The lift table platform 4 is guided for back and forth vertical movements in upstanding support means 14.

Road stones or bricks are stacked onto the lift table platform 4 in planar slab or pallet arrangements 5. The slabs 5 are road stone layers piled one on top of the other to form a supply stack within the paving machine 1. It is within the contemplation of the present invention that the slabs 5, depicted in FIG. 1, may be in the form of a unitary paving stone piece or, in accordance with the preferred embodiment, can be a composite arrangement of a group of individual shaped bricks held together by means of foils or the like when being stacked in the machine.

Figure 2:
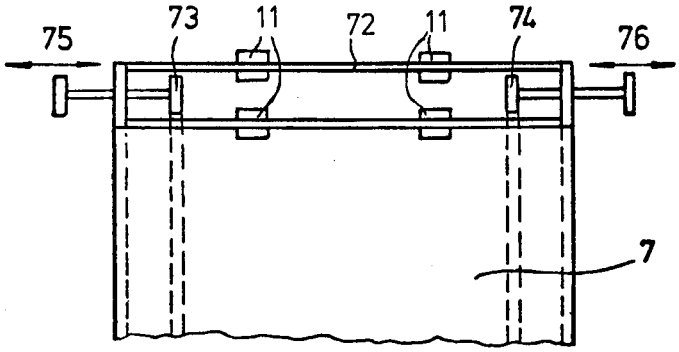
FIG. 2 is a schematic, side elevational view taken along the lines II—II of FIG. 1.

At the forward end of the paving machine 1, there is mounted a semicircular transfer chute or track 7 through which uppermost slabs 5' in the supply stack are sequentially transported down to the subgrade surface S. In its simplest form, the transfer chute is constructed as an arc-shaped housing having a rectangular cross-section guidetrack surface. The chute is formed with an upper end input opening 72 for receiving slabs from the supply stack and a lower end discharge opening 71 disposed, during paving operations, substantially contiguous with the subgrade surface S. Preferably, roller means 11, as shown in FIG. 2, are arranged in the transfer chute 7 for guiding movement of the slabs through the transfer housing. Practice has shown that such rollers are only necessary in special instances when the slab stones are formed of irregular design. Normally, the weight of the slabs and the pressure exerted as the slabs are inserted into the transfer chute 7 is sufficient in itself to move the slabs through the transfer track housing. When used, the sequence of rollers are placed closer to one another than the length of the shortest individual stone to be transported or contained within the slab.

Each individual slab 5 moves within the transfer track 7 and out onto the subgrade S through the discharge opening 71 of the chute. The deposited slab is pressed directly against previously laid slabs forming a pavement surface P on the roadway. Each slab stone is pressed against the immediately previously laid pavement stone by virtue of the shear weight of the following slab stones contained in the transfer chute and, in addition, due to the pressure exerted by a laterally movable insertion device 8, which pushes each uppermost slab 5' into the input opening 72 of the transfer track 7. As illustrated in FIG. 1, the insertion device 8 is positioned along the upper portion of the machine frame and formed with a laterally movable push rod element connected to a drive means 81. The drive means 81 is preferably a hydraulic cylinder mechanism; however, other suitable drive means, such as a mechanical or gear drive, a spindle drive, or an electically driven chain conveyor, may also be employed.

A planar support plate member 12, shown in FIG. 1, is also provided for lateral insertion between the uppermost slab 5' and the next adjacent slab in preparation for insertion of the uppermost slab into the transfer chute 7. Suitable support and drive means serve to operate the support plate 12 for corresponding back and forth movement in the paving machine 1. Immediately prior to insertion of the uppermost slab 5' into the chute opening 72, clamp mechanism C a portion of one of which is, shown in FIG. 3, engage the slab from opposed transverse sides to laterally support the slab over the supply stack.

Each clamp device C comprises a series of pin members 9 which face the outer surfaces of the individual road stones in the slab, extending in the direction perpendicular to the feed direction movement of the insertion device 8. The pins 9 are guided in a bracket rail 10 and are resiliently biased toward the stones by means of tension spring members 15. A support strip 13, movable in the direction of the indicated arrow, serves to operate the clamp pins 9 between an operational position whereby the pin faces press against the slab stones and a retracted position whereby the pins are disposed out of engagement with the slab. In the operational clamping position, the pins 9 of both clamping devices C hold the slab compressed together by virtue of engagement by the pins and tension of their spring members over the supply stack.

Figure 3:
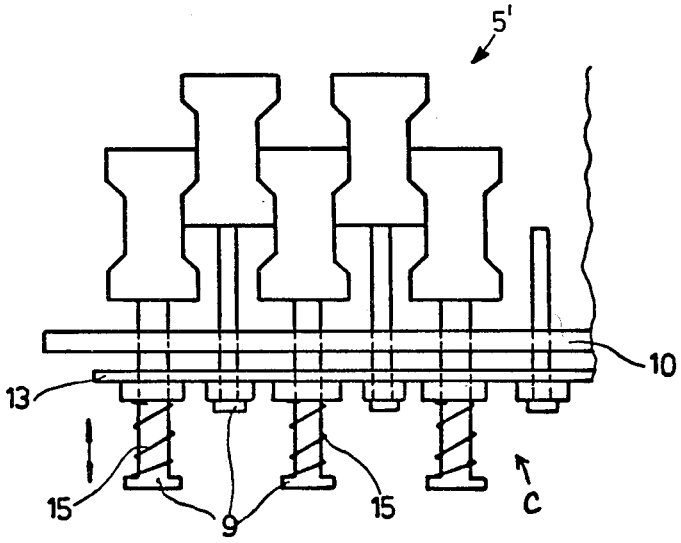
FIG. 3 is a schematic, plan view of a clamp device for slab stones utilized in the road construction machine of FIG. 1.

With the clamping mechanisms C in the operational position, the lift table 4 is lowered creating a gap between the clamped slab and the supply stack. The support plate 12 is then inserted into this gap beneath the clamped slab. The clamp means are then released, such that the slab is supported on the support plate 12 across from the inlet opening 72 of the transfer chute 7. The insertion device 8 is then activated to push the slab 5' into the chute 7, whereupon prior slab stones still contained in the transfer track are pressed toward the discharge opening 71 and, accordingly, laid on the roadway surface S. The particular arrangement of the clamp device C shown in FIG. 3 enables interfitted shaped bricks composing the slab to maintain their position; and where the blocks are aligned such that the longer dimension of the blocks is parallel to the chute opening and transverse to the direction of travel of the machine frame 1, as depicted in FIG. 3, the blocks of one slab 5' are able to fit into those of the previously laid slab.

Hydraulic press means are provided for ramming the stones with a vertical back and forth movement, forcing the stones into a fixed position in the road bed S. Ram head portions 17 of the press means are preferably disposed adjacent the transport wheel assembly 2, so that, during upward movements of the ram heads, the transport wheels provide a ramming motion against the stones. This follow-up ramming motion is particularly effective due to the dead weight of the supply of slabs to be laid carried in the machine frame.

After a paving operation is completed, the machine 1 is able to be returned back over the paved surface P in the following manner. The transport wheel assembly 2 is carried in a hydraulic cylinder 6, which is actuated to press the transport wheels 2 downward against the paved surface P. This action lifts the forward end of the machine frame 1 such that the discharge opening 71 of the transfer chute 7 is raised above the surface of the laid stones. In this cantilevered position, the machine 1 can be moved backward over the paved surface and, thus, conducted to a different location.

Figure 4:
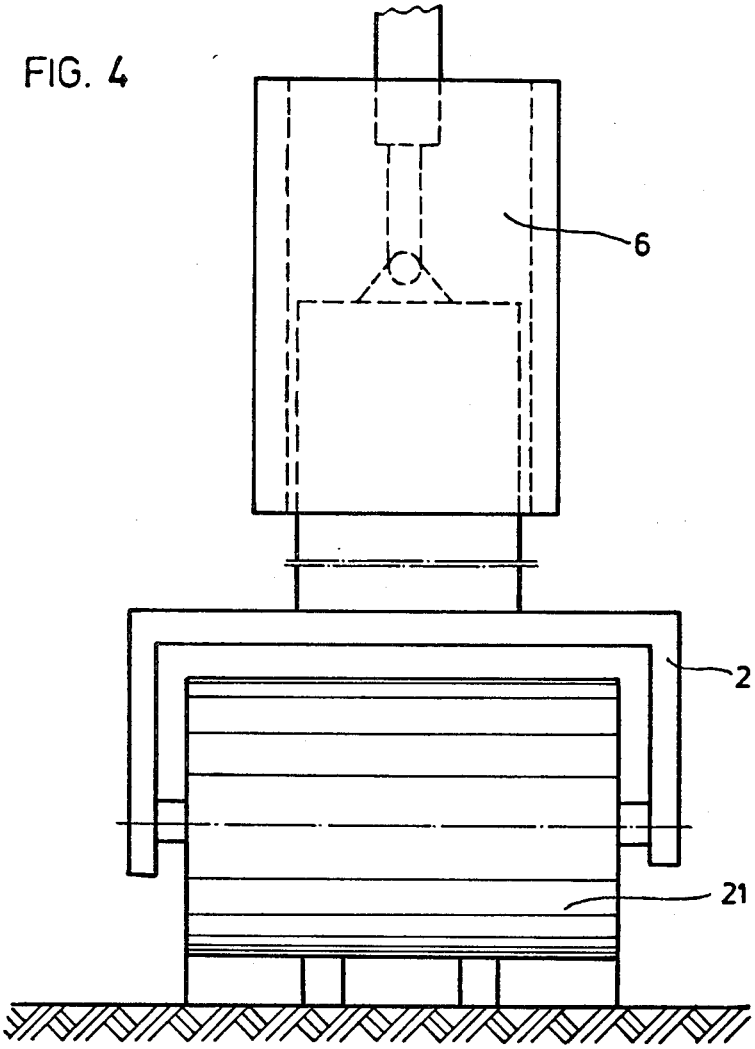
FIG. 4 is a schematic, front elevational view illustrating an alternate embodiment for the front transport wheel assembly utilized in the road construction machine of FIG. 1.

FIG. 4 illustrates a further embodiment of the transport wheel assembly 2, wherein drum means 21 are rotatably guided over the laid stones. The drum 21 may be provided with a drive means for movement of the paving machine 1 or the drum member may rotate freely and such drive means may be provided at the rear transport rollers 3.

Figure 5:
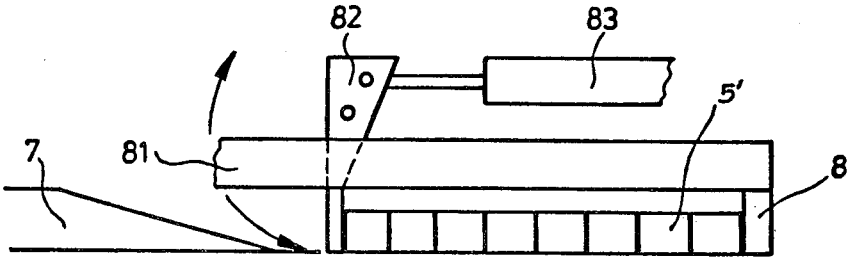
FIG. 5 is a schematic, side elevational view illustrating an alternate embodiment for the insertion device utilized in the road construction machine of FIG. 1.

FIG. 5 illustrates an alternate embodiment for the insertion device 8, wherein a pivotable plate means 82, which is laterally movable in a hydraulic cylinder 83, is used to clamp the uppermost slab 5' against the insertion push element while the support plate 12 is positioned underneath the slab. During insertion of the slab into the transfer chute 7, the plate 82 is pivoted upwardly out of the way of the slab stones entering the inlet opening 72.

In order to keep the prearranged group of stones united in a slab, it may also be desirable to provide two transversely adjustable guide elements 73 and 74 adjacent the opposed side surfaces of the transfer track 7. Corresponding control elements 75 and 76, accessible from outside the transfer chute can be adjusted in the direction of the indicated arrows to respectively set the guide elements 73 and 74 in proper position. The guide surfaces 73 and 74 may be biased with the assistance of springs, so that the guide elements resiliently contain the slab stones in position with lateral pressure during movement of the slabs through the transfer chute. Alternatively to the planar surfaces shown, ball bearing surfaces may also be provided at the guide elements 73 and 74.

It is further within the contemplation of the present invention that alternate constructions could be utilized for the clamping mechanisms C. For example, grab members, rather than pins, could be placed laterally against the slab to be inserted into the transfer chute 7 movable from above and below the slab. A clamp device which functions in a purely hydraulic manner is also within the framework of the invention.

A wide variety of slab composites are within the contemplation of the present invention. For example, slabs composed of tiles or the like can be laid with the inventive paving machine. Corresponding guide rollers, matched to the respective slab composites being used, would then be provided in the transfer chute.

It is further within the contemplation of the present invention that the inventive road construction machine can be employed to paved very large surfaces, such as runways for aircraft, as well as for paving walks and the like. In every instance, the inventive machine is guided on the pavement already laid and, thereby, lays the pavement slab for slab in the direction of forward motion of the machine.

Although various minor modifications may be suggested by those versed in the art, it should be understood that I wish to embody within the scope of the patent warranted hereon all such modifications as reasonably and properly come within the scope of my contribution to the art.

I claim as my invention:

1. Apparatus for laying road stones on a relatively soft subgrade surface to produce a paved surface, comprising a movable machine frame having a lift table means for supporting a layered supply stack of road stones for vertical movement in said machine frame, a transfer chute means in the form of a simicircular housing for conducting uppermost road stone layers from said supply stack from an inlet opening end to said subgrade surface for laying through a discharge opening end, said transfer chute means positioned at the forward end of said machine frame in the direction of paving such that subsequently laid stones are gravitationally pressed against previously-laid stones, an insertion means mounted on said machine frame for intermittently feeding each said uppermost road stone layer from said supply stack into said transfer chute means inlet opening end, and means for supporting said machine frame for movement in the paving direction comprising wheel members secured to said machine frame and riding directly on said surface being laid.

2. The apparatus of claim 1, wherein said transfer chute means contains guide roller means positioned above and below said road stones passing therethrough.

3. The apparatus of claim 2, further comprising transversely movable plate means mounted along opposed sides of said transfer chute means for guiding said road stones therethrough.

4. The apparatus of claim 1, wherein said insertion means comprises a hydraulically reciprocable push element for engaging with each uppermost road stone layer.

5. The apparatus of claim 1, further comprising a clamp means mounted on said machine frame for laterally supporting each said uppermost road stone layer over said supply stack prior to its insertion into said transfer chute means.

6. The apparatus of claim 5, further comprising a laterally reciprocable support plate means for moving between said uppermost layer of road stones and a next adjacent layer for supporting said uppermost layer of road stones as said insertion means passes said uppermost layer into said transfer chute means.

7. The apparatus of claim 1, further comprising reciprocable press means for shaking said machine frame over said paved surface to press and flatten said laid road stones in said subgrade surface.

8. The apparatus of claim 1, wherein said support means wheel members comprise front and back transport assemblies, said front assembly being vertically reciprocable such that said front assembly can be pressed against said paved surface to cantilever said machine frame for movement of said machine frame back over said paved surface.

9. The apparatus of claim 8, wherein said front transport assembly comprises a relatively large drum wheel.

* * * * *